US005080528A

United States Patent [19]

Ressi di Cervio

[11] Patent Number: 5,080,528

[45] Date of Patent: Jan. 14, 1992

[54] METHOD AND APPARATUS FOR IMPOUNDING FLUIDS

[75] Inventor: Arturo L. Ressi di Cervio, New York, N.Y.

[73] Assignee: Finic, B.V., Rotterdam, Netherlands

[21] Appl. No.: 471,688

[22] Filed: Jan. 30, 1990

Related U.S. Application Data

[63] Continuation of Ser. No. 432,873, Oct. 5, 1982, abandoned, which is a continuation-in-part of Ser. No. 252,676, Apr. 9, 1981, abandoned.

[51] Int. Cl.[5] ..... B09B 1/00

[52] U.S. Cl. ..... 405/38; 405/53; 405/128

[58] Field of Search ..... 405/36, 37, 38, 52, 405/53, 54, 55, 57, 128, 129, 270

[56] References Cited

U.S. PATENT DOCUMENTS

| | | | |
|---|---|---|---|
| 1,665,104 | 4/1928 | Martienssen | 405/38 |
| 3,736,754 | 6/1973 | Azalbert | 405/53 |
| 3,908,385 | 9/1975 | Daniel et al. | 405/37 |
| 4,194,855 | 3/1980 | Egger | 405/128 |
| 4,296,884 | 10/1981 | Luebke | 405/36 X |
| 4,335,978 | 6/1982 | Mutch | 405/129 |
| 4,345,581 | 8/1982 | Shacher | 405/53 X |
| 4,352,601 | 10/1982 | Valiga et al. | 405/270 |
| 4,358,221 | 11/1982 | Wickberg | 405/128 |
| 4,362,434 | 12/1982 | Valiga et al. | 405/53 X |

*Primary Examiner*—Dennis L. Taylor
*Assistant Examiner*—J. Russell McBee
*Attorney, Agent, or Firm*—Jim Zegeer

[57] ABSTRACT

A cavity is excavated in the earth with preferably sloping sidewalls and a first impervious barrier or layer is placed on the surface of the excavation, such as a layer of plastic film or sheet. One or more self-starting pumps are placed at intervals along the slope and embedded in a pervious layer, such as sand, of from one to three feet in thickness. An inner impervious layer which, in a preferred embodiment, is substantially thicker than the outer or first impervious layer is layed over the sand and then a final layer or cap of clay is applied over the inner impervious plastic layer. Any seepage or leakage through the inner impervious layer caused by a tear or imperfection in the plastic, flows down to the self-starting monitoring pumps which, upon sensing the flow, turns itself on. The invention includes sensing the time of operation of the self-monitoring pump to determine the degree of seepage.

6 Claims, 1 Drawing Sheet

METHOD AND APPARATUS FOR IMPOUNDING FLUIDS

This is a continuation of application Ser. No. 06/432,873, filed Oct. 5, 1982, which was abandoned upon the filing hereof, which is a continuation-in-part of application Ser. No. 06/252,676, filed Apr. 9, 1981, now abandoned.

BACKGROUND AND BRIEF DESCRIPTION OF THE INVENTION

In the past, impoundment ponds for fluids have been constructed using layers of plastic for lining the surface of an excavation in the earth which are usually then covered with a layer of clay to maintain the plastic in a uniform condition, exclude air bubbles and to protect it from tears and the like. In my application Ser. No. 252,676, I disclose a vertical cut-off system that assures absolute water tightness wherein a pair of plastic films are used to line a slurry trench and a pervious layer fills the space between the two plastic layers to act as a filter. Draining of the filter material is used as a method of maintaining the effectiveness of the barrier and with a minimum amount of pumping at intervals guaranteeing that any pollutant which crosses the initial barrier is collected and eliminated. The object of the present invention is to extend that plastic, pervious layer and pump-plastic layer technique to large impoundment ponds without the use of slurry walls. According to this invention, an impoundment pond is constructed in the usual fashion by excavating the impoundment pond space in the earth and lining same with a layer first layer of plastic. Thereafter, according to the present invention, a system of self-starting pumps are placed in collecting pipes at uniform intervals along the slope of the impoundment walls or surfaces. These pipes are of such a diameter as to receive conventional self-starting pumps e.g. pumps which sense the presence of a fluid and automatically begin pumping the fluid when it reaches a predetermined level. The pipes are covered with a pervious layer such as sand and then an inner layer of plastic, which in the preferred embodiment, is significantly thicker than the outer layer is applied over the pervious layer and then the conventional cap or layer of clay is applied thereover. The outer ends of the two plastic layers may be sealed or otherwise covered with a clay cap so as to prevent the draining of surface water thereinto.

BRIEF DESCRIPTION OF THE DRAWINGS

The above and other objects, advantages and features of the invention will become more apparent from the following specification taken in conjunction with the accompanying drawings wherein:

The basic method of this invention for constructing an impoundment pond comprises excavating the pond in the earth with the sidewalls being tapered or sloped so as to assure that all pollutants flow towards the center of the impoundment pond. It will be appreciated that the design of such impoundment ponds has been widely carried out in the past insofar as the depth, slopes and preparation of the sidewalls and bottom is concerned and need not be described herein. Moreover, the plastic materials which are used according to this invention are conventional in that they are impervious plastic films such as polyethylene with or without strengthening scrimms or meshes therein. As shown in FIG. 1, the impoundment pond 10 has sidewalls 11, 12, 13 and 14 and a bottom 15, the sidewalls 11-14 sloping to the surface. Such ponds can vary in size from a few acres to many many acres and need not have square sides but can have irregularly shaped sides. The invention is in the construction and operation of the surface of sidewalls 11-14 and the bottom wall 15.

According to this invention, after excavating to form the side and bottom walls of the impoundment ponds, a first or outer layer 20 of impervious material such as plastic, preferably polyethylene or a similar product, with or without a strengthening mesh, is applied to the excavated surface 19 which has been prepared to be as smooth and as freed of sharp projections as possible. This first layer 20 of plastic film is, in a preferred embodiment, 10 to 20 mils in thickness and is applied substantially uniformly to assure that there are no openings or gaps in this layer. Hence, when the plastic is layed down in parallel strips, the adjacent edges of the strips are all heat sealed or fused together either by sonic welding or by induction or electrical heating techniques, well known in the art. After the outer layer 20 has been layed and smoothed on the excavated surface and care taken to assure that all air bubbles have been removed, a network of drain pipes 21, which can be conventional casing pipes perforated and slotted so as to permit fluid to egress therein is provided with a filter at the end. Such drain pipes 21 are of a diameter so as to permit the introduction therein and placement of self-starting pumps 25 which are used for monitoring the flow of fluid either from external of the pond or from the internal of the pond. In other words, as soon as any fluid flows into any of the drain pipes, the pump 25 automatically starts. These drain pipes 21 are typically six to eight inches in diameter and are spaced between thirty to one hundred feet on centers depending on the degree of monitoring desired and the size of the pond. As shown in FIG. 4, a standpipe in the center can be coupled to the self-starting pump to remove seepage from the center of the pervious layer.

Figure 1:
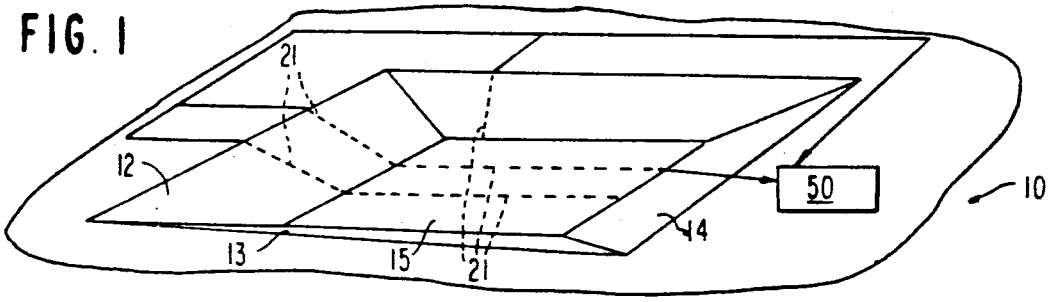
FIG. 1 is an isometric sectional view of an impoundment pond incorporating the invention.
Figure 2:
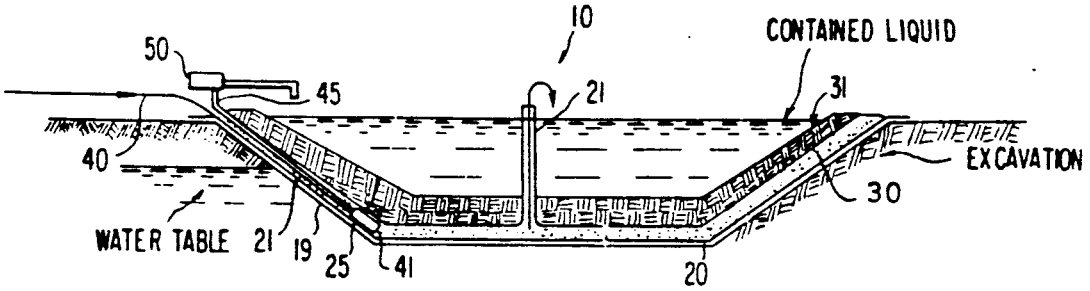
FIG. 2 is a sectional view of the walls of the impoundment pond incorporating the invention.

After the system of drain pipes has been installed, they are covered with a layer of fluid pervious material, preferably sand, of one to three feet in thickness, a two foot thickness being typical. This sand is smoothed to the contours of walls 11, 12, 13, 14 and bottom surface 15. A second or inner layer of plastic 30 is then applied over the sand, this layer of plastic being in a preferred embodiment substantially thicker than the outer or first layer 20. This layer may for example be 60 mils in thickness but; one would not go beyond the invention if the two layers of plastic were of identical composition and thickness. Again, if the plastic is layed down in parallel strips, the adjoining or juxtaposed edges are sealed to make them impervious as by sonic welding or by electronic heating.

Finally, a conventional clay cap or layer 31 is applied over the inner plastic layer 30, such clay layer being typically of two to three feet in thickness and assures that the plastic films or layers remain in place and also serves as a protective barrier or layer against tearing and puncturing of such films.

Figure 3:
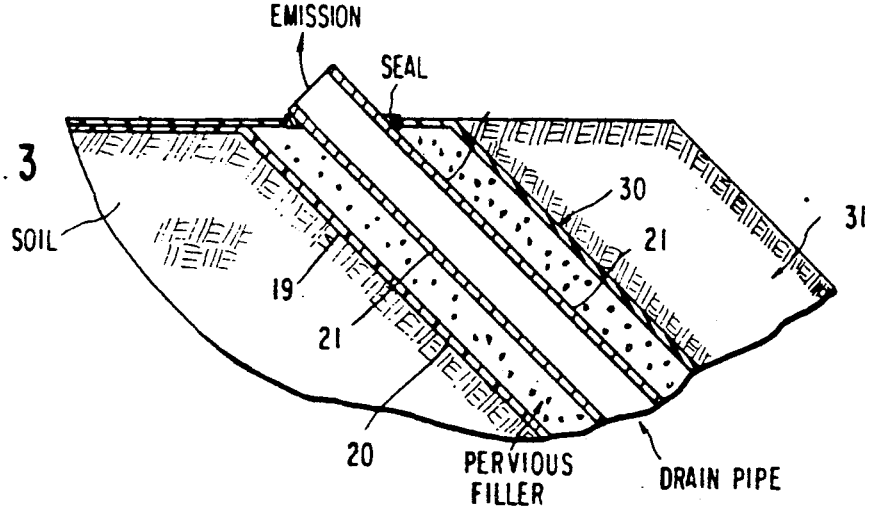
FIG. 3 is an enlarged sectional view showning a drainage pipe and pumps therein incorporating the invention and FIG. 4 shows the connection of the standpipe of FIG. 2 to the top liner and the granular fill.
Figure 4:
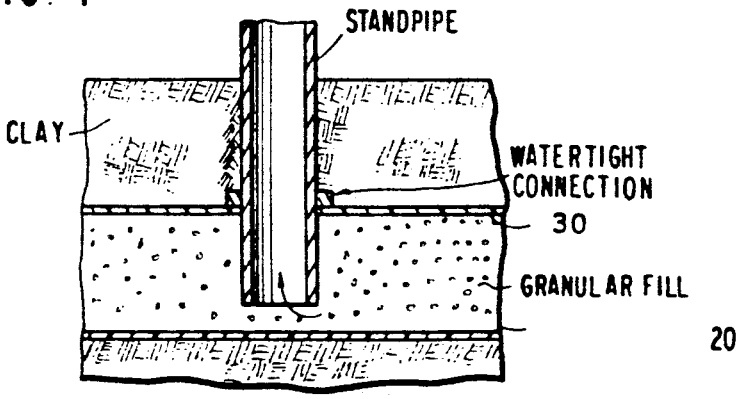

FIG. 3 is a section through a typical pump-plastic-pervious layer as illustrated. Here, the pump 25 is a typical submerged subursible pump having means 41 for sensing the fluid at a drain level in the drain pipe and automatically turning the pump 25 on. Power lines 40 to the surface as well as the line 45 carrying the seepage material to the surface are contained in the drain pipe. At the surface, a monitoring unit 50 monitors and records on a strip chart, for example, the flow rate of seepage material below the impoundment level, the seepage material being returned to the impoundment pond. The monitor may also record the time of operation of the self-monitoring pumps to determine the degree of seepage.

While I have shown and described a preferred embodiment of the invention, it would be appreciated that various other modifications can be carried out without departing from the spirit of the invention as defined by the claims appended hereto.

What is claimed is:

1. An impoundment pond comprising:

sloped earth sidewalls and a bottom wall forming a cavity in the earth surface, a first impervious plastic sheet layer at least 10 mils thick on said earth walls.

a pervious layer on said first impervious plastic sheet layer, including lower levels, a system of drainage pipes in said pervious layer, self-starting pump means in said lower levels for pumping fluids from lower levels to the earth surface, said drainage pipes being of a diameter to receive said self-starting pump means, means for sensing the time of operation of said self-starting pump means to determine the degree of seepage from said impoundment pond, a second impervious plastic sheet layer thicker than said first impervious plastic sheet layer on said pervious layer, and a final protective layer on said second impervious layer.

2. The impoundment pond defined in claim 1, said impoundment pond having a top level, and including stand pipe, said stand pipe having one end projecting above said top level of said impoundment pond and its opposite end sealingly coupled through said second impervious plastic and said final protective layer to said pervious layer.

3. The invention defined in claim 1 wherein said first impervious plastic sheet layer is polyethylene 10–20 mils thick, said pervious layer is sand which is 1 to 3 feet thick, said second impervious plastic sheet layer is polyethylene about 60 mils thick and said final protective layer is clay which is about 2 feet thick.

4. An impoundment pond comprising:

earth walls forming a cavity in the earth, said cavity having sloped sidewalls and a bottom wall, said cavity having an upper level, a relatively thin first plastic sheet contiguous to said earth side and bottom walls, a pervious layer on said relatively thin first plastic film, means for determining the degree of seepage into said pervious sand layer from said impoundment pond, said means for determining including a system of drainage pipes in said pervious layer, a self-starting pump connected to said drainage system for pumping fluids from between said first and second plastic sheets, means for monitoring operation of said pumps to determine seepage from said impoundment pond, a relatively thick second plastic sheet, said second plastic sheet being substantially thicker than said first plastic sheet and lying on the surface of said pervious layer, a protective clay layer on said relatively thick second plastic sheet, and a standpipe having an upper end and lower end with said upper end projecting above said upper level of said cavity and said lower end being sealingly coupled through said protective layer to said relatively thick second plastic layer and projecting into said pervious layer.

5. The impoundment pond defined in claim 4 wherein said pervious layer is a granular material 1 to 3 feet thick.

6. The invention defined in claim 4 wherein said first plastic sheet is about 10 to 20 mils thick, said relatively thick plastic sheet is about 60 mils thick, said pervious layer is about 2 feet thick, and said protective clay layer is 2 to 3 feet thick.

* * * * *